United States Patent [19]

Morris et al.

[11] 4,220,124

[45] Sep. 2, 1980

[54] ADJUSTABLE AIR VANE GOVERNOR

[75] Inventors: Richard L. Morris, Galesburg, Ill.; William H. Wulff, Cedar Grove, Wis.

[73] Assignee: Outboard Marine Corporation, Waukegan, Ill.

[21] Appl. No.: 915,764

[22] Filed: Jun. 15, 1978

[51] Int. Cl.[2] ..... F02D 11/02

[52] U.S. Cl. ..... 123/391; 56/10.2

[58] Field of Search ..... 123/103 R, 103 B, 103 E, 123/108, 179 SE, 198 DB; 56/10.2

[56] References Cited

U.S. PATENT DOCUMENTS

| | | | |
|---|---|---|---|
| 2,836,159 | 5/1958 | Morben | 123/103 B |
| 3,161,186 | 12/1964 | Reichenbach et al. | 123/103 B |
| 3,650,252 | 3/1972 | Glover et al. | 123/103 B |

*Primary Examiner*—Charles J. Myhre
*Assistant Examiner*—Craig R. Feinberg
*Attorney, Agent, or Firm*—Michael, Best & Friedrich

[57] ABSTRACT

Disclosed herein is a lawn mower comprising a blade housing, wheels for supporting the blade housing for movement along the ground, a rotary cutting blade supported in the blade housing, and an internal combustion engine carried by the blade housing and rotatably driving the rotary cutting blade. The engine includes a carburetor and a movable throttle control for controlling fluid flow through the carburetor, the throttle control being movable from an open position to a flow restricting position. The engine further includes a movable air vane connected to the throttle control for moving the throttle control, a fan for impelleing air against the air vane so as to urge the throttle control to the flow restricting position, and a spring connected to the throttle control for urging the throttle control toward the open position.

5 Claims, 4 Drawing Figures

ADJUSTABLE AIR VANE GOVERNOR

RELATED APPLICATION

Attention is directed to U.S. Pat. Application Ser. No. 915,662, filed June 15, 1978, and assigned to the assignee of the present invention.

BACKGROUND OF THE INVENTION

The invention relates to power driven lawn mowers and more particularly to lawn mowers including internal combustion engines having governors for controlling the speed of operation of the lawn mower.

Engine efficiency and durability are increased if the engine of a lawn mower operates at a generally constant speed, and it is desirable that the engine speed be maintained below a pre-selected value to provide for proper operation of the machine. Accordingly, it is beneficial if the engine is provided with a governor for maintaining control of the engine speed. It is further desirable that the governor be adjustable during assembly of the lawn mower to permit the desired engine speed to be pre-established, and that the governor should then be precluded from any further adjustment once the pre-established engine speed has been set.

SUMMARY OF THE INVENTION

The invention provides an internal combustion engine comprising a carburetor including therein a throat, and a cylindrical stem projecting transversely from the throat and having a central bore communicating with the throat, a pivotal throttle member position in the throat and pivotable from an open position to a fluid flow restricting position, a movable air vane, a rotatable shaft positioned in the central bore and connected to the air vane and to the throttle member for moving the throttle member in response to movement of the air vane, means responsive to engine rotation for impelling air against the air vane so as to move the air vane and so as to urge the throttle member to the flow restricting position, resilient means having one end connected to the throttle member for urging the throttle member toward the open position and having a second end, adjustment means connected to the second end of the resilient means for adjusting the force of the resilient means on the throttle member, which adjustment means includes an adjustment member movable axially between a first position affording rotary adjustment of the resilient means and a second position spaced axially of the shaft from the first position and anchoring the second end of the resilient means, and locking means independent of the resilient means for releasably preventing axial movement of the member from the second to the first positions and for preventing rotary adjustment of the member when in the second position.

One of the principal features of the invention is the provision of adjustment means connected to the resilient means for adjusting the force of the resilient means on the throttle control and means for securing the adjustment means in an adjusted position.

Another of the principal features of the invention is the provision of the adjustment means including a collar surrounding the rotatable shaft and movable in the direction of the shaft axis between a first collar position wherein the collar is rotatable about the shaft axis for adjusting the tension of a spring biasing the throttle disc toward the open position and a second collar position, and locking means for preventing rotation of the collar when the collar is in the second position.

Another of the principal features of the invention is the provision of an air vane and a rotatable shaft which are integrally joined in one piece.

Other features and advantages of the embodiments of the invention will become apparent to those skilled in the art upon reviewing the following detailed description, the drawings and the appended claims.

Figure 1:
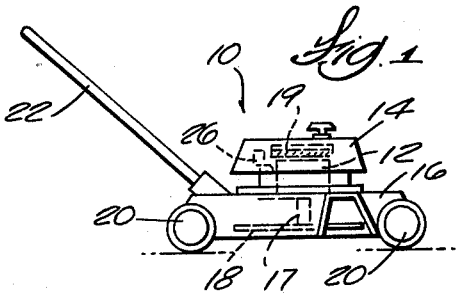
FIG. 1 is a side elevation view of a lawn mower embodying the present invention.

Before explaining one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in the drawings is a lawn mower 10 including an internal combustion engine 12 partially covered by a shroud 14 and supported on a frame including a blade housing 16. The engine 12 rotatably drives an engine drive shaft 17 having a rotary cutting blade 18 attached to its lower end. The upper end of the drive shaft 17 drives a rotary cooling fan 19. The mower 10 is supported for movement along the ground by wheels 20 and is guided by a guiding handle 22.

The internal combustion engine 12 is provided with a carburetor 26 having a throat 30, the throat 30 including therein a generally cylindrical bore 32. The speed of the engine 12 is governed by the flow of the fuel mixture through the cylindrical bore 32 of the throat 30.

An air vane governor 34 is provided to regulate flow of the fuel mixture through the throat 30. The air vane governor 34 includes a generally circular throttle disc 36 pivotally supported in the throat 30 and movable between a flow restricting position wherein the throttle disc 36 defines a plane transverse to the longitudinal axis of the throat 30 and an open position, as shown in FIGS. 2 and 3, wherein the plane of the throttle disc 36 is generally parallel to the longitudinal axis of the throat 30 and flow through the throat is substantially unrestricted by the throttle disc 36.

The throttle disc 36 is joined to the lower end of a throttle control shaft 38. The throttle control shaft 38 includes a lower end extending into the cylindrical bore 32 of the throat 30 and is supported for rotation about a vertical axis generally perpendicular to the longitudinal axis of the cylindrical bore 32 by a cylindrical stem 40 extending vertically upwardly from the throat 30 and integrally joined to the throat 30. The cylindrical stem 40 includes a central bore 42 for rotatably supporting the throttle shaft 38.

Figure 4:
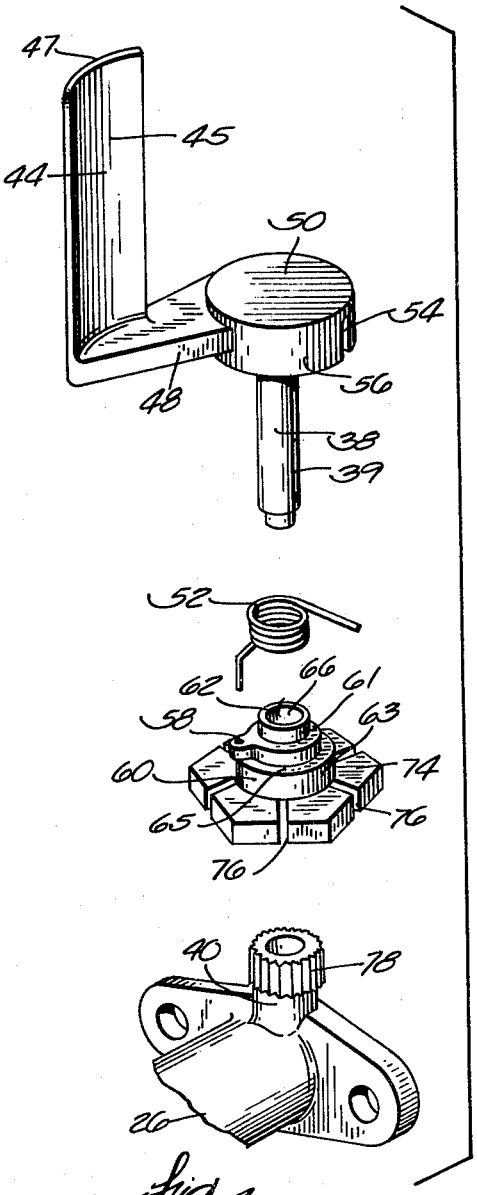
FIG. 4 is an exploded perspective view of the air vane governor assembly shown in FIGS. 2 and 3.

An air vane 44 is attached to the upper end of the throttle shaft 38 and is functional to control rotation of the throttle shaft 38 and thereby control pivotal movement of the throttle disc 36 between its open position and its flow restricting position. The rotary cooling fan 19, attached to the engine drive shaft 17, includes a plurality of radially extending impeller blades 46, shown in FIGS. 2 and 3. The air vane 44 is positioned adjacent the periphery of the fan 19 such that rotation of the fan 19 causes the impeller blades 46 to impel air against the surface of the air vane 44 to apply a force on the air vane 44 proportional to the speed of rotation of the fan 19 and the engine 12. As shown in FIG. 4, in one preferred embodiment of the invention, the air vane 44 can be comprised of a vertically extending, generally rectangular blade curved about a vertical axis and having concave and convex vertical surfaces 45 and 47, respectively. The concave surface 45 generally faces the periphery of the fan 19. The air vane 44 is spaced from the longitudinal axis of the throttle shaft 38 and is connected to the throttle shaft 38 by an air vane supporting arm 48 having one end connected to the air vane and the opposite end connected to a cylindrical vane supporting body 50. The vane supporting body 50 is in turn integrally connected to the upper end of the throttle shaft 38. The air vane 44 is positioned such that when the fan 19 forces air against the air vane, the air vane 44 and the air vane supporting arm 48 apply a torque on the throttle shaft 38 to bias the throttle disc 36 toward a flow restricting position.

Figure 2:
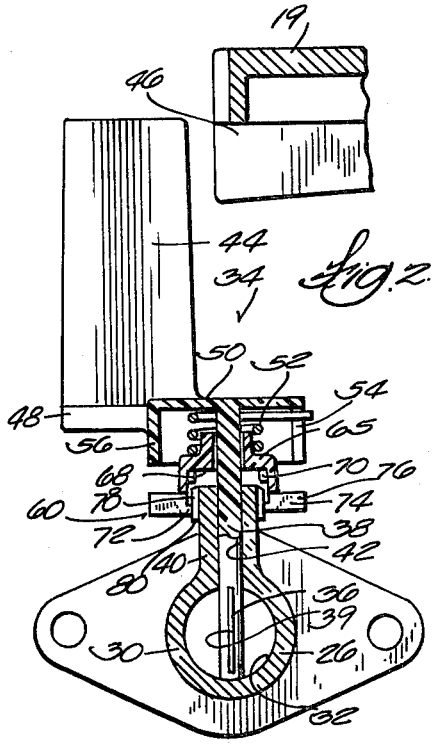
FIG. 2 is an enlarged cross-section view of an air vane governor assembly embodied in the lawn mower shown in FIG. 1 and showing an adjustment collar in an adjustable position.
Figure 3:
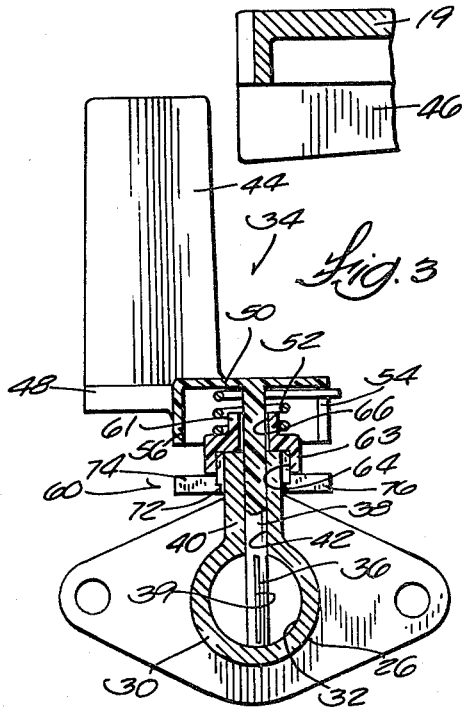
FIG. 3 is a view similar to FIG. 2 but showing the adjustment collar in a second position wherein the adjustment collar is precluded from movement.

In one preferred embodiment of the invention, the air vane 44, the vane supporting arm 48, the vane supporting body 50, and the throttle shaft 38 can be integrally formed from molded plastic as shown in FIG. 2. The throttle shaft 38 can further include a longitudinal slot 39 in its lower end for supporting the throttle disc 36. In other embodiments of the invention, air vane 44, vane supporting arm 48, vane supporting body 50, and throttle shaft 38 can be comprised of discrete components which are mechanically joined.

The force of the air vane 44 on the throttle shaft is balanced by a force from a torsional governor spring 52 acting on the throttle shaft 38 and urging the throttle disc 36 toward its open position. The air vane 44 and the torsional governor spring 52 thus function to control the speed of the engine 12. More specifically, the spring 52 biases the throttle disc to an open position, thereby tending to permit increased flow of the fuel mixture through the carburetor throat 30. Such increased flow causes the speed of the engine 12 to increase. Accordingly, as the speed of rotation of the rotary fan 19 increases, the air flow from the fan 19 against the air vane 44 exerts a torque on the throttle shaft 38 causing the throttle disc 36 to be biased toward a flow restricting position to thereby reduce the engine speed. In the event that the engine speed is caused to be reduced by the blade 18 encountering a resistance such as heavy grass, the fan 19 will have a reduced rotational speed. The force on the air vane 44 will be proportionally reduced and the torsional governor spring 52 will function to bias the throttle disc 36 toward an open position whereby fluid flow through the carburetor is permitted to increase and the engine speed will be increased. In this manner, the torsional governor spring 52 and the air vane 44, in combination with the cooling fan 19, tend to cause the engine 12 to run at a constant speed and to compensate for loads placed on the engine.

The torsional governor spring 52 is shown in FIGS. 2, 3 and 4 as being a helically wound spring having opposite ends, one of the ends being held in a slot 54 in a downwardly extending peripheral wall 56 of the cylindrical vane supporting body 50, and the other end of the spring 52 being positioned in an aperture 58 in an adjustment collar 60.

The adjustment collar 60 includes a cylindrical portion 61 extending upwardly into the coils of the torsional governor spring 52, and an integral larger diameter lower portion 63 surrounding an upper portion of the stem 40. The upper cylindrical portion 61 of the adjustment collar 60 and the larger diameter portion 63 are joined by a shoulder 65 which supports the lower end of the torsional governor spring 52. The collar 60 also includes a central stepped bore 62 having a larger diameter portion 64 within the lower portion 63 of the collar 60 and a smaller diameter portion 66 within the upper cylindrical portion 61. The larger diameter portion 64 of the bore 62 surrounds the end of the cylindrical stem 40 extending upwardly from the carburetor body 26 and the smaller diameter portion 66 of the bore 62 surrounds the throttle shaft 38. The stepped bore 62 of the collar 60 also includes an annular shoulder 68 between the larger diameter bore and the smaller diameter bore 66, the shoulder 68 being intended to be positioned against the upper end of the stem 40 as shown in FIG. 3.

The collar 60 also includes a plurality of mating elements which can be in the form of splines 70 extending inwardly from the periphery of the larger diameter portion 64 of the bore 62, the splines 70 surrounding a portion of the larger diameter bore portion 64 adjacent the shoulder 68. The opposite lower end of the larger diameter bore portion 64 supports an inwardly extending deformable annular lip 72 surrounding the bore 64 and spaced downwardly from splines 70. The collar 60 further includes an annular flange 74 extending outwardly from the lower portion of the collar 60. The periphery of the annular flange 74 has a hexagonal configuration, and the annular flange 74 includes a plurality of radial slots 76 cut therein and extending inwardly from the periphery. The radial slots 76 are intended to permit radially outward expansion of the annular lip 72 so that the collar 60 can be forced onto the upper end of the stem 40, thus providing a means for releasably preventing movement of the collar axially from the lower position which is shown in FIG. 3 and which anchors one end of the spring 52, and to the upper position which is shown in FIG. 2 and which affords rotary adjustment of the collar 60 to control the tension in the spring 52.

The stem 40 projecting upwardly from the carburetor body 28 includes an upper end surrounded by a plurality of mating elements which can be in the form of splines 78 intended to mate with the internal splines 70 of the collar 60.

The speed of the engine 12 in operation is governed by the load and the rate of the torsional governor spring 52. It is desirable that the speed of operation of the engine be pre-adjusted during one of the final assembly steps to achieve a pre-selected engine speed. It is further desirable that once the governor has been adjusted to provide a pre-selected engine speed, further adjustment should be prevented so that the engine will thereafter operate at that pre-selected speed. To permit such preadjustment, during assembly of the lawn mower 10, the collar 60 is positioned on the stem 40 in the manner shown in FIG. 2, wherein the inwardly extending annular lip 72 of the collar 60 is expanded to engage the outer periphery of the splines 78 of the stem 40, and the inwardly extending splines 70 of the collar 60 are spaced upwardly from the splines 78 on the stem 40. In this position, the collar 60 is rotatable relative to the stem 40 and relative to the air vane supporting body 50 to permit adjustment of the tension of the torsional governor spring and consequent adjustment of the engine speed. When the desired tension in the torsional governor spring 52 has been achieved, the collar 60 can then be forced downwardly in the direction of the longitudinal axis of the stem 40 to the position shown in FIG. 3 wherein the inwardly extending splines 70 of the collar 60 engage the splines 78 of the stem 40 to thereby prevent relative rotation of the collar 60 and the stem 40. By providing fine splines 70 and 78, accurate adjustment of the engine speed can be achieved. After the collar 60 has been forced downwardly to cause engagement of splines 70 and 78, the inwardly extending annular lip 72 surrounding the lower end of the collar 60 collapses into engagement with the shoulder 80 formed by the lower end of the splines 78 surrounding the stem 40 to thereby prevent upward movement of the collar 60. The collar 60 is thus locked onto the stem 40 in a snapfit relationship and is precluded from rotation with respect to the stem by engagement of the complementary splines 70 and 78.

Various of the features of the invention are set forth in the following claims.

What is claimed is:

1. An internal combustion engine comprising a carburetor including therein a throat, and a cylindrical stem projecting transversely from said throat and having a central bore communicating with said throat, a pivotal throttle member positioned in said throat and pivotable from an open position to a fluid flow restricting position, a movable air vane, a rotatable shaft positioned in said central bore and connected to said air vane and to said throttle member for moving said throttle member in response to movement of said air vane, means responsive to engine rotation for impelling air against said air vane so as to move said air vane and so as to urge said throttle member to said flow restricting position, resilient means having one end connected to said throttle member for urging said throttle member toward said open position and having a second end, adjustment means connected to said second end of said resilient means for adjusting the force of said resilient means on said throttle member, said adjustment means including an adjustment member movable axially between a first position affording rotary adjustment of said resilient means and a second position spaced axially of said shaft from said first position and anchoring said second end of said resilient means, and locking means independent of said resilient means for releasably preventing axial movement of said member from said second to said first positions and for preventing rotary adjustment of said member when in said second position.

2. An internal combustion engine in accordance with claim 1 wherein said adjustment member comprises a collar surrounding said stem and movable from a first position on said stem wherein said collar is fixed with respect to said stem, to a second position on said stem wherein said collar is rotatable relative to said stem.

3. An internal combustion engine comprising a carburetor including therein a throat, a cylindrical stem projecting transversely from said throat and having a central bore communicating with said throat, a pivotal throttle member positioned in said throat and pivotable from an open position to a fluid flow restricting position, a movable air vane, a rotatable shaft positioned in said central bore and connected to said air vane and to said throttle member for moving said throttle member in response to movement of said air vane, means responsive to engine rotation for impelling air against said air vane so as to move said air vane and so as to urge said throttle member to said flow restricting position, resilient means connected to said throttle member for urging said throttle member toward said open position, adjustment means connected to said resilient means for adjusting the force of said resilient means on said throttle member, said adjustment means including a collar surrounding said stem and movable from a first position on said stem wherein said collar is rotatable relataive to said stem to a second position on said stem wherein said collar is fixed with respect to said stem, said collar including a central bore having opposite ends, and locking means for preventing relative movement of said stem and said collar when said collar is in said second position, said locking means including first mating elements on said collar adjacent one of said opposite ends of said collar bore, means for precluding movement of said collar from said second position to said first position, said precluding means including an inwardly extending annular lip adjacent the other of said opposite ends of said bore, and a shoulder extending from said stem and engaging said annular lip when said collar is in said second position, and second mating elements on said stem, said mating elements being engaged when said collar is in said second position.

4. An internal combustion engine as set forth in claim 3 wherein said means for impelling air against said air vane is a rotary cooling fan rotatably driven and positioned adjacent said air vane and for impelling air against said air vane.

5. An internal combustion engine as set forth in claim 3 wherein said air vane and said rotatable shaft are integrally joined in one piece.

* * * * *